US005640892A

United States Patent [19]

Kauss et al.

[11] Patent Number: 5,640,892

[45] Date of Patent: Jun. 24, 1997

[54] HYDRAULIC CONTROL DEVICE

[75] Inventors: Wolfgang Kauss, Ste Foy les Lyon, France; Armin Stellwagen, Lohr/Main, Germany

[73] Assignee: Mannesmann Rexroth GmbH, Lohr/Main, Germany

[21] Appl. No.: 387,898

[22] PCT Filed: Aug. 5, 1993

[86] PCT No.: PCT/EP93/02082

§ 371 Date: Feb. 16, 1995

§ 102(e) Date: Feb. 16, 1995

[87] PCT Pub. No.: WO94/04829

PCT Pub. Date: Mar. 3, 1994

[30] Foreign Application Priority Data

Aug. 20, 1992 [DE] Germany ..... 42 27 564.4
Sep. 19, 1992 [DE] Germany ..... 42 31 399.6

[51] Int. Cl.[6] ..... F15B 11/08; F15B 13/04

[52] U.S. Cl. ..... 91/447; 91/448; 91/461

[58] Field of Search ..... 91/444, 446, 448, 91/447, 462, 466, 461

[56] References Cited

U.S. PATENT DOCUMENTS

| | | | |
|---|---|---|---|
| 4,508,013 | 4/1985 | Barbagli . | |
| 4,622,883 | 11/1986 | Mucheyer | 91/461 X |
| 5,095,806 | 3/1992 | Valdemar et al. | 91/461 X |
| 5,097,746 | 3/1992 | Asaoka et al. | 91/461 |
| 5,353,684 | 10/1994 | Schwing | 91/446 |
| 5,490,492 | 2/1996 | Rub et al. | 91/446 X |

FOREIGN PATENT DOCUMENTS

| | | |
|---|---|---|
| 0218901 | 4/1987 | European Pat. Off. . |
| 0281635 | 5/1988 | European Pat. Off. . |
| 3840328 | 5/1990 | Germany . |
| 8806241 | 8/1988 | WIPO . |

OTHER PUBLICATIONS

Patent Abstracts of Japan, vol. 8, No. 253 (M–339), Nov. 20, 1984 & JP, A, 59 126 184 (Kawasaki) Jul. 20 1984.
Patent Abstracts of Japan, vol. 5, No. 151 (M–089) Sep. 24, 1981 & JP, A, 56 080 573 (Kayaba), Jul. 1, 1981.
Patent Abstracts of Japan, vol. 5, No. 172 (M–095), Oct. 31,1981 & JP, A, 57 097 682 (Kabaya), Aug. 6, 1981.

*Primary Examiner*—Hoang Nguyen
*Attorney, Agent, or Firm*—Martin A. Farber

[57] ABSTRACT

A hydraulic control device having a directional valve by means of which the direction of movement and the speed of a hydraulic consumer, especially a mobile working device can be modified. The hydraulic control device has a hydraulic pre-control device by which a control pressure can be applied, via a first control line, to a first control chamber and, via a second control line, to a second control chamber of the directional valve, and having valve arrangement in a first control line by which a largely free flow of control oil is admitted to a first control chamber and by which, by a throttling of the discharge of control oil, the movement of a control slide of the directional valve can be damped. To obtain an effective damping, but to avoid a delay of the start of the movement or of the end of the movement of the working device of a mobile working machine, the damping of the movement of the control slide can be controlled as a function of the control pressure in a first control chamber and/or of the control pressure in a second control chamber.

20 Claims, 4 Drawing Sheets

HYDRAULIC CONTROL DEVICE

FIELD AND BACKGROUND OF THE INVENTION

The present invention relates to a hydraulic control device having a directional valve by which the direction of movement and the speed of a hydraulic consumer, especially a mobile working device, can be modified. Such a hydraulic control device is known from actual use on excavators.

Mobile working machines such as, in particular, wheel excavators or wheel loaders frequently operate without support. Under these circumstances the entire vehicle can be incited to oscillation upon rapid actuation of a working function, these oscillations then being propagated via the cab to the driver. If the oscillating circuit is closed over the operating element of the pre-control device, the operating movement is unstable and can no longer be controlled. A sudden transition to large control signals namely brings about large forces of acceleration so that strong oscillations can be excited. Furthermore, the control slide of the directional valve is then in a steeply ascending region of the characteristic curve of the directional valve and thus in the region of high amplification, so that the tendency to oscillate is further promoted.

In order to dampen the oscillations it is known to install valve arrangement developed as throttle non-return valves in the control lines to the control slide of the directional valve. Good damping action would be obtained if the damping cross section were selected very small. In that way, however, the course of the movement is delayed. A delaying of the start of the movement is annoying for the part of the operator and leads to the danger of overcontrol. A delay in the end of the movement results in an "overrunning" of the working device, which makes precise work difficult and furthermore represents a safety risk. For these reasons, only slight damping is used in the known control devices, which, however, does not reduce the susceptibility to oscillation of the entire system to the extent desired.

SUMMARY OF THE INVENTION

The object of the invention is so to develop such a hydraulic control device so that the tendency of the entire system to oscillate can be further reduced without unacceptable delays in the course of the movement of a working device.

According to the present invention a hydraulic control device is provided, wherein the damping of the movement of the control slide of the directional valve can be controlled as a function of the control pressure in a second control chamber. With a hydraulic control device in accordance with the invention, the two requirements, which at first sight might appear to be contradictory, for a good damping of oscillations and a delay-free start and end of the operation can be satisfied simultaneously. The movement of the control slide is then essentially only damped when the pre-control device is in the region of high control pressures and thus of a steep rise of the stroke/volume flow characteristic curve of the directional valve. Upon the start and the end of the movement, there is also passed over, in each case, a region of the characteristic curve in which the control pressure and the rise of the characteristic curve are slight and which is generally referred as the fine-control region. In this region, the damping is greatly reduced or entirely done away with in the manner that the damping of the movement of the control slide (9) is disconnected below a given control pressure and connected above said control pressure. The start of the movement and the end of the movement of an operation are therefore not delayed.

As already stated, the characteristic curve of known directional valves have a slowly rising region and a steeply rising region, the transition between the two region being located at about one third of the maximum control pressure. According to a feature of the invention, it is now advantageously provided that the movement of the control slide can be damped as from a control pressure which is about one third of the maximum control pressure. As long as the control pressure is below one third of the maximum control pressure, the movement is not damped.

According to another feature of the invention, a second directional valve is preferably used, depending on the position of which the damping can be varied. It is possible in this connection to employ as directional valve a continuous valve, in which case the degree of the damping is dependent on the position of a valve body of the directional valve. The directional valve can, however, also be a switch valve. in which case the movement of the control slide is not damped in the one switch position, while in the other switch position it is damped by a throttle having a fixed, predetermined throttle cross section.

Particularly if the throttle is combined with a non-return valve, it may be cost-favorable and inexpensive from a design standpoint if, in accordance with still another feature of the invention, a fixed throttle is provided which is not influenced by the second directional valve and if a bypass which bypasses the fixed throttle can be switched by the second directional valve, the bypass being open in the position of rest of the second directional valve so that no throttling of the volumetric flow takes place, and being blocked to a greater or lesser extent in a working position of the second directional valve, in particular entirely blocked. The throttle can then be arranged on a valve body of the non-return valve and be moved with it, in which case a cleaning effect for the throttle is also obtained. To this extent, this solution appears more favorable than one in which the pre-control device and the first control chamber are connected unthrottled to each other via the directional valve in the position of rest of the second directional valve and a throttle point is switched into the first control line in a working position of the second directional valve. To be sure, such an embodiment affords the possibility of integrating the throttle point in the directional valve and, for instance, so developing it by a groove on a control piston of the directional valve that structural space can be saved. At the same time, the result is thus obtained that the throttle is moved together with the control piston and a certain cleaning effect also takes place. This, to be sure, is somewhat less than in a case in which the throttle is on the non-return body of a non-return valve, since when the directional valve is developed as switch valve, the control piston of the second directional valve is only moved when the control pressure at which the second directional valve switches is exceeded in upward or downward direction.

Free admission and throttled discharge of control oil is obtained in simple fashion in accordance with another feature of the invention, in the manner that a non-return valve which opens towards the first control chamber is connected in parallel to the second directional valve and that the directional valve can be switched as a function of the control pressure in a blocking position for the first control line.

From a structural standpoint, the second directional valve is preferably developed in the manner that a valve body seeks to assume a position of rest under the action of at least one valve spring and is hydraulically actuatable against the force of a valve spring. For this purpose, a first control chamber can be acted on by the control pressure prevailing in one control line and a second, spring-side control chamber can be acted by on by the tank pressure which prevails in the other control line. In this case, a development in accordance with yet another feature of the invention permits the use of only a single valve spring, which is furthermore simple to arrange and adjust. The controlling of the second directional valve, however, appears simpler if its valve body seeks to assume a middle position of rest under the action of at least one valve spring and if the first control chamber is connected with one control line and the second control chamber with the other control line. It is then not necessary to switch between the control lines depending on the pressure acting on them, so that the first control chamber is in each case connected to the control line in which a control pressure is present. Rather, the two control chambers can be connected fast to one and the other control line respectively, since, upon actuation of the pre-control device, in a given direction, control pressure prevails in the one control line and tank pressure in the other control line, and this is reversed upon actuation of the pre-control device in opposite direction from the middle position.

In the known hydraulic control devices, both control lines are provided with a valve arrangement for throttling the discharge of the control oil. At relatively little expense, the throttling can be controlled by a single directional valve having four work connections. If two directional valves are used, they can be set to different switch pressures.

The damping of the movement of the control slide is impaired if the control oil present in the control lines and in the control chambers contains air bubbles. The air present can be reduced by connecting a flushing nozzle between the two control lines via which nozzle the control oil can flow from the control line acted on by control pressure to the control line in which tank pressure prevails. In accordance with the advantageous embodiment of the invention, it is now provided that the flushing nozzle is integrated in the second directional valve. In this case, it appears particularly favorable if, in accordance with another feature of the invention, the connection of the two control lines is closed via the flushing nozzle in an actuated position of the second directional valve in which a high control pressure prevails in the one control line. In this way, the flushing nozzle cannot impair the building-up of the control pressure.

The valve arrangement and the second directional valve are preferably arranged in a common housing, one advantageous arrangement being that the housing (44) has two continuous parallel holes (45, 46) into each of which a throttle or throttle non-return valve (20, 21) is inserted; and that the housing (44) has a further hole (49) which extends parallel to a plane spanning the axes of the first two holes (45, 46) and perpendicular to the first two holes (45, 46) and in which there is a control piston (47) of the second directional valve (25).

BRIEF DESCRIPTION 0F THE DRAWINGS

With the above and other advantages in view, the present invention will become more clearly understood in connection with the detailed description of preferred embodiments, when considered with the accompanied drawings, of which:

DESCRIPTION OF THE PREFERRED EMBODIMENTS

Figure 1:
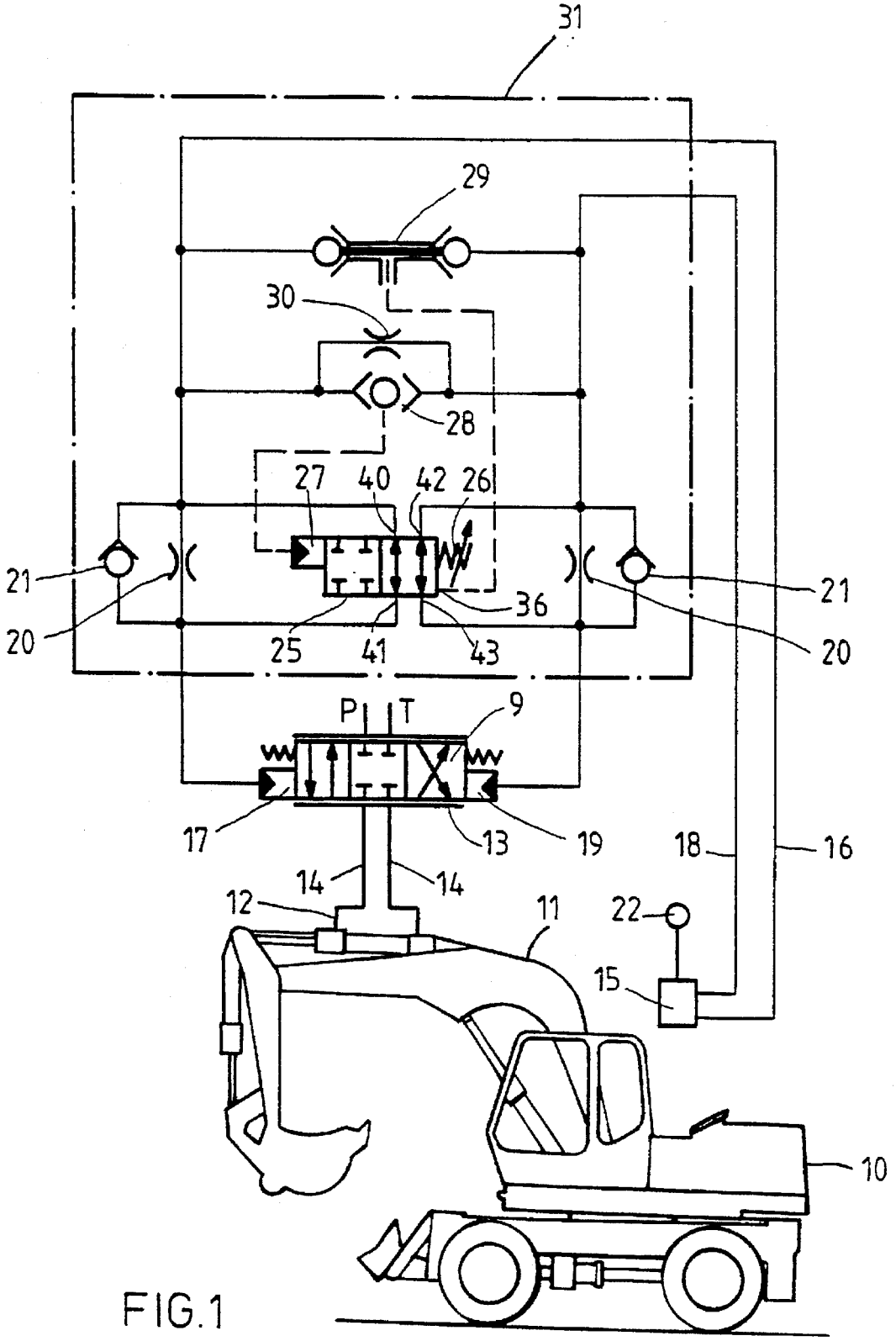
FIG. 1 shows a hydraulic control device having a single, second directional valve which is associated with both control lines and has a control chamber which can be connected alternately to one or the other control line.

In FIG. 1 there can be noted a wheel excavator 10 the various parts of the boom 11 of which are movable with respect to each other via double-acting hydraulic cylinders 12. One hydraulic cylinder 12 can be actuated via a first directional valve 13 having a control slide 9, from which two consumer lines 14 lead to the hydraulic cylinder 12, and which consists of a known continuous valve which has a spring-centered middle position from which it can be brought hydraulically into its lateral working position. It is controlled by means of a manually actuated pre-control device 15, from which one control line 16 leads to a control chamber 17 and one control line 18 leads to a control chamber 19 of the directional valve 13. In each of the two control lines, there is installed a throttle non-return valve having a throttle 20 and a non-return valve 21 which opens towards the corresponding control chambers 17 and 19 respectively.

The pre-control device 15 operates on the basis of direct-controlled pressure-reduction valves. Depending on the deflection of the actuating element 21, a given control pressure can be built up in one of the control lines 16 or 18. The other control line is connected in each case to the tank. Let us now assume that the actuating lever 20 is deflected in such a manner that a control pressure is built up in the control line 16. Control oil then flows over the corresponding non-return valve 21 into the control chamber 17, while control oil is displaced out of the control chamber 19 and, since the other non-return valve closes, flows back to the pre-control device 15 via the corresponding throttle 20 and the control line 18. The discharging control oil is therefore throttled. Upon deflection of the actuating lever 22 in the opposite direction, pressure is present in the control line 18 and control oil flows into the control chamber 19. Control oil is displaced in throttled manner out of the control chamber 17.

The two throttles 20 are to enter into action only when the control pressure exceeds a given pressure. This pressure depends essentially on the stroke/volumetric flow characteristic curve of the directional valve 13 and lies in the region in which this characteristic curve passes from a flat section into a steep section. This pressure is normally about one third of the highest control pressure. If the latter therefore is 30 bars, the throttles 20 only enter into action when the control pressure rises above 10 bar.

In order to achieve this, a second directional valve 25 is provided which has two inlets 40, 42 and two outlets 41, 43, one inlet on the one side and the corresponding outlet on the other side of a throttle 20 being connected with one of the two control lines 16 or 18. The directional valve 25 has a position of rest and a working position, the position of rest being assumed on basis of the action of a compression spring 26, and the working position being obtained by hydraulic actuation in the manner that pressure is applied to the control chamber 27. For this purpose, the control chamber 27 can be connected via a change valve 28 with the control line in which a control pressure is present. The chamber in which the compression spring 26 is located is connected, via a control line, to an inverted change valve 29 and connected by the latter in each case to the control line in which tank pressure prevails. The compression spring 26 is so adjusted that the directional valve 25 is shifted from its position of rest into its working position when a control pressure of 10 bars prevails in the control chamber 27. In the position of rest of the directional valve 25, an inlet which is connected between a throttle 20 and the pre-control device 25 to a control line and an outlet which is connected between the throttle 20 and the first directional valve 13 to the same control line are connected to each other. A bypass to the throttle 20 is thus established so that the throttle 20 is without action in the position of rest of the second directional valve 25. This is true as long as the control pressure is less than 10 bar.

In the working position of the second directional valve 25, the two inlets and two outlets are blocked. If the directional valve 25 is in this working position, control oil which wishes to flow out through a control chamber 17 or 19 must flow over the throttle 20.

In order for the amount of air in the control oil to remain small, the two control lines 16 and 18 between the throttle 20 and the pre-control device 15 are connected to each other via a flushing nozzle 30, via which, during each actuation of the pre-control device 15, a certain amount of control oil flows off from the control line which is acted on by control pressure to the other control line and from there into the tank.

A dash-dot line indicates that the two throttle non-return valves, the second directional valve 25, the change valve 28, the inverted change valve 29, the flushing nozzle 30, and the hydraulic connections between these parts are contained in a single housing block 31.

If the control pressure changes rapidly, it may happen that the control slide 9 of the directional valve 13 moves beyond the position corresponding to the control pressure set and swings back again despite the throttling of the discharging control oil. During the swinging back, control oil is displaced from the control chamber acted on by pressure. Because of the non-return valve 21 which blocks towards the pre-control device, this control oil is also throttled when the second directional valve 25 is in its working position.

In the embodiment shown in FIG. 1, a throttle 20 and a non-return valve 21 are located in each control line 16 and 18. Furthermore, the throttling of the stream of oil in both control lines can be modified by the second directional valve 25. Depending on the direction of deflection of the actuating lever 22 therefore one or the other control lines is the first or the second, and the one and the other control chambers 17, 19 the first or the second. From the foregoing description, it is seen that the foregoing hydraulic device comprises a directional valve by which a hydraulic load can be controlled, a hydraulic pre-control device from which control lines lead to the directional valve, and a valve arrangement in a control line. According to the embodiments, a valve arrangement is present in each control line.

Figure 2:
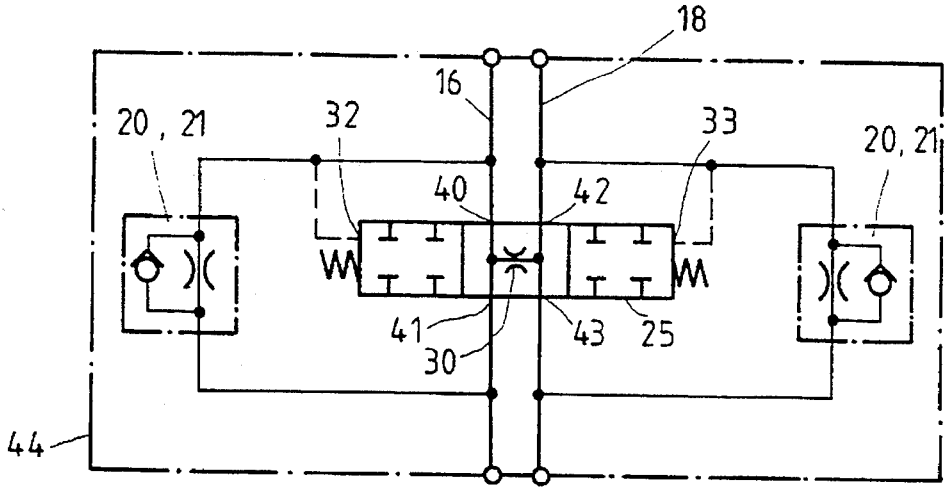
FIG. 2 shows a second directional valve which again is intended for both control lines and has three switch positions and is arranged, with two valve arrangements for the throttling of the discharge of the control oil, in a single housing.

In the embodiment shown in FIG. 2, a second directional valve 25 is used which valve has a middle position which is centered by two oppositely acting compression springs 26 which are preset to 10 bar, in which position a bypass is connected to the two throttle non-return valves 20, 21, and two lateral working positions in which all work connections 40 to 43 of the directional valve 25 are blocked. The directional valve 25 now has two control chambers 32 and 33, one of which is connected to the control line 16 and the other to the control line 18. The flushing nozzle 30 is integrated in the directional valve 25. Due to the fact that the directional valve 25 now has two lateral working positions and can be actuated in opposite directions from the center position, the change valve and the inverted change valve can be dispensed with, in contradistinction to the embodiment shown in FIG. 1. Since, in each case, control pressure prevails in the one control line 16 or 18 and tank pressure in the other, the corresponding pressures result in the control chambers 32 and 33 also in case of a direct connection of these chambers to the control lines.

Figure 3:
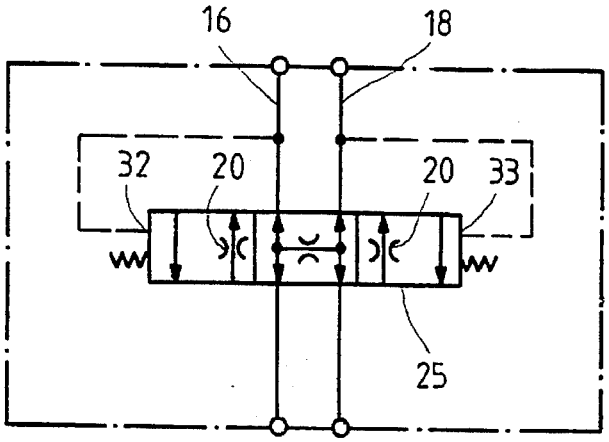
FIG. 3 shows another embodiment of a second directional valve in which two throttles are integrated, they being adapted to be switched into the control lines.

The directional valve 25 of FIG. 3 is controlled in exactly the same manner as that of FIG. 2 and, in the same way as the latter, has three switch positions, namely a spring-centered middle position and two lateral working positions. In the working positions, however, the connections are not blocked. Rather, in one working position of the directional valve 25 according to FIG. 3, the one control line 16 or 18 remains open and a throttle 20 integrated into the directional valve is connected into the other control line. A non-return valve as in the embodiments of FIGS. 1 and 2 is not present. After a swinging of the control slide of the first directional valve, oil flowing back from the first control chamber is not throttled.

Figure 4:
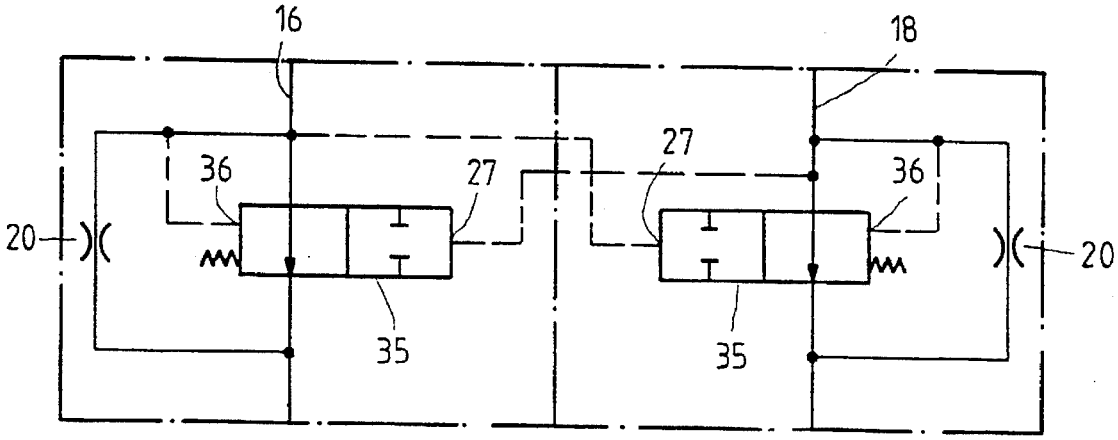
FIG. 4 shows an embodiment with two second directional valves, each of which is associated with a control line.

The embodiment according to FIG. 4 corresponds substantially to the embodiment of FIG. 1. However, the one directional valve 25 having four work connections is divided into two directional valves 35, each of which has only two work connections. This division furthermore has the result that one directional valve 35 which is associated with the one control line 16 or 18 can be connected with the spring-side control chamber 36 directly to this control line and with the control chamber 27 directly to the other control line. In this connection, as in the embodiment according to FIG. 1, the connection of the control chamber 36 to the corresponding control line has merely the function of leading leakage oil away. Control pressure which may be present in the control chamber has no effect.

Figure 5:
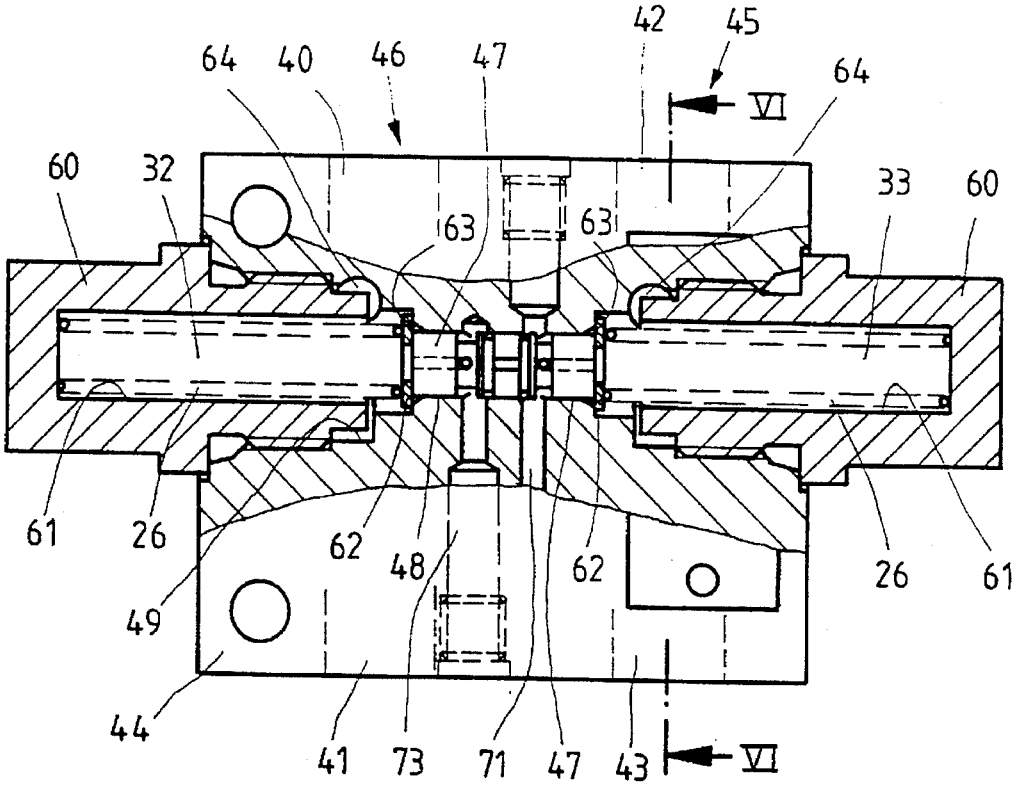
FIG. 5 is a partial section through a valve to which, within a common housing, a second directional valve and two throttle non-return valves belong, and the switch legend of which is that of FIG. 2.
Figure 6:
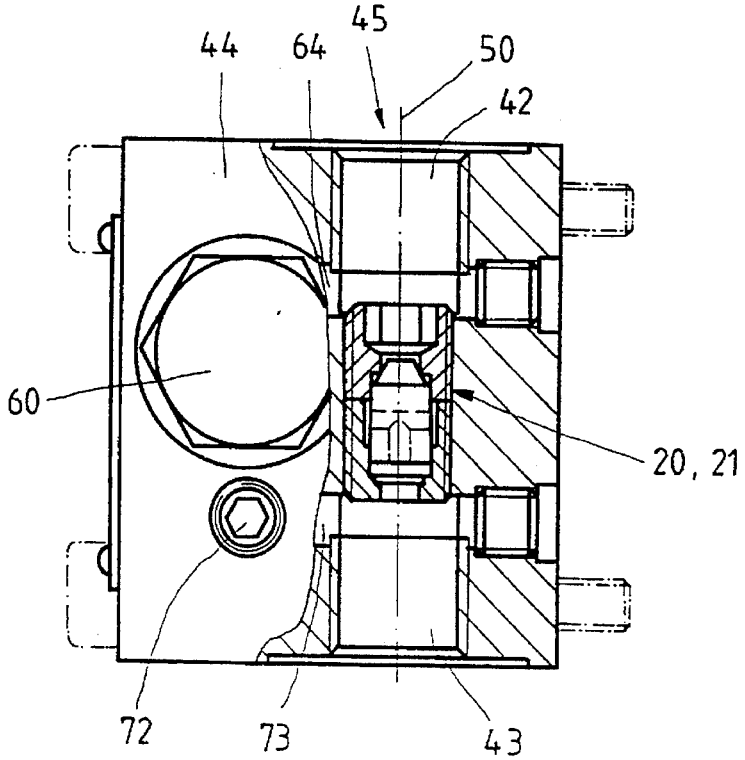
FIG. 6 is a partial section along the line VI—VI of FIG. 5.

In FIGS. 5 and 6 there can be noted a housing block 44, which is indicated by a dash-dot line in FIG. 2. This housing block 44 has two continuous holes 45 and 46 which extend parallel to each other and in which a throttle return valve 20, 21 is installed between an inlet 40 or 42 and an outlet 41 or 43 respectively. The directional valve 25 has a control piston 47 which is displaceable in a central section 48 of another continuous hole 49 in the housing block 44, which hole extends parallel to a plane 50 spanned by the two holes 45 and 46 and is perpendicular to the holes 45 and 46. Two closure plugs 60 are screwed from opposite directions into the hole 45, they receiving a coil compression spring 26 in a blind hole 61. Each of the two coil compression springs rests against the bottom of the blind hole 61 and against a disk 62 which rests on a step 63 in the hole 49 when the control piston 47 is in the middle position. The distance apart of the two steps 63 is only slightly greater than the length of the control piston 47, so that, upon a displacement of the control piston 47 from its central position, one of the two compression springs 26 is cocked, via a corresponding disk 62 which grips radially inward over the control piston 47. The other compression spring rests., via the other disk 62, on the housing block 44 and remains without action during a displacement of the control piston 47 in the one direction. Both compression springs 26 are so pretensioned that a control pressure of about 10 bar is necessary in order to displace the control piston 47. The spring constant of the compression springs 36 is selected very small, so that the pressure range within which the control piston 47 is displaced from the middle position into a lateral working position is very small.

In order to displace the control piston 47, a control pressure must be built up in one of the two control chambers 32 and 33 in which the compression springs 26 are also located. For this purpose, the control chamber 33 is connected by a transverse hole 64 to the inlet 42. From the end 65 facing the control chamber 33 of the control piston 47, a blind hole 66 which is arranged in the axial direction of the control piston 47 extends, into which hole a transverse hole 67 in the control piston 47 debouches at a distance from the end 65. Within the region of the transverse hole, the control piston 47 has a circumferential annular groove 68 which is limited on the one side by an end annular collar 29 and on the other side by a central annular collar 70. From the middle section 48 of the hole 49 there extends a channel 71 towards which the annular groove 68 is open in the middle position of the control piston 47 shown in the upper half of FIG. 7. On the other hand, in the one lateral working position of the control piston 47, which is shown in the lower half of FIG. 7, the annular collar 69 covers the channel 71. The channel 71 is connected to the outlet 43 of the housing block 44 by a further blind-hole-like channel which extends parallel to the hole 49 and is closed by a closure plug 72 and by a further transverse hole 73 parallel to the transverse hole 64. A corresponding connection between the inlet 40 and the outlet 41 is present over another transverse hole 64, the control chamber 32, a further blind hole 66, a further transverse hole 67, and a further annular groove 68 in the control piston 47, as well as over a channel 71, a further channel parallel to the hole 49, and a further transverse hole 73.

It is thus clear that in the middle position of the control piston 47 a bypass to the throttles 20 is open. In a side working position of the control piston 47 on the other hand, the bypass is closed.

Figure 7:
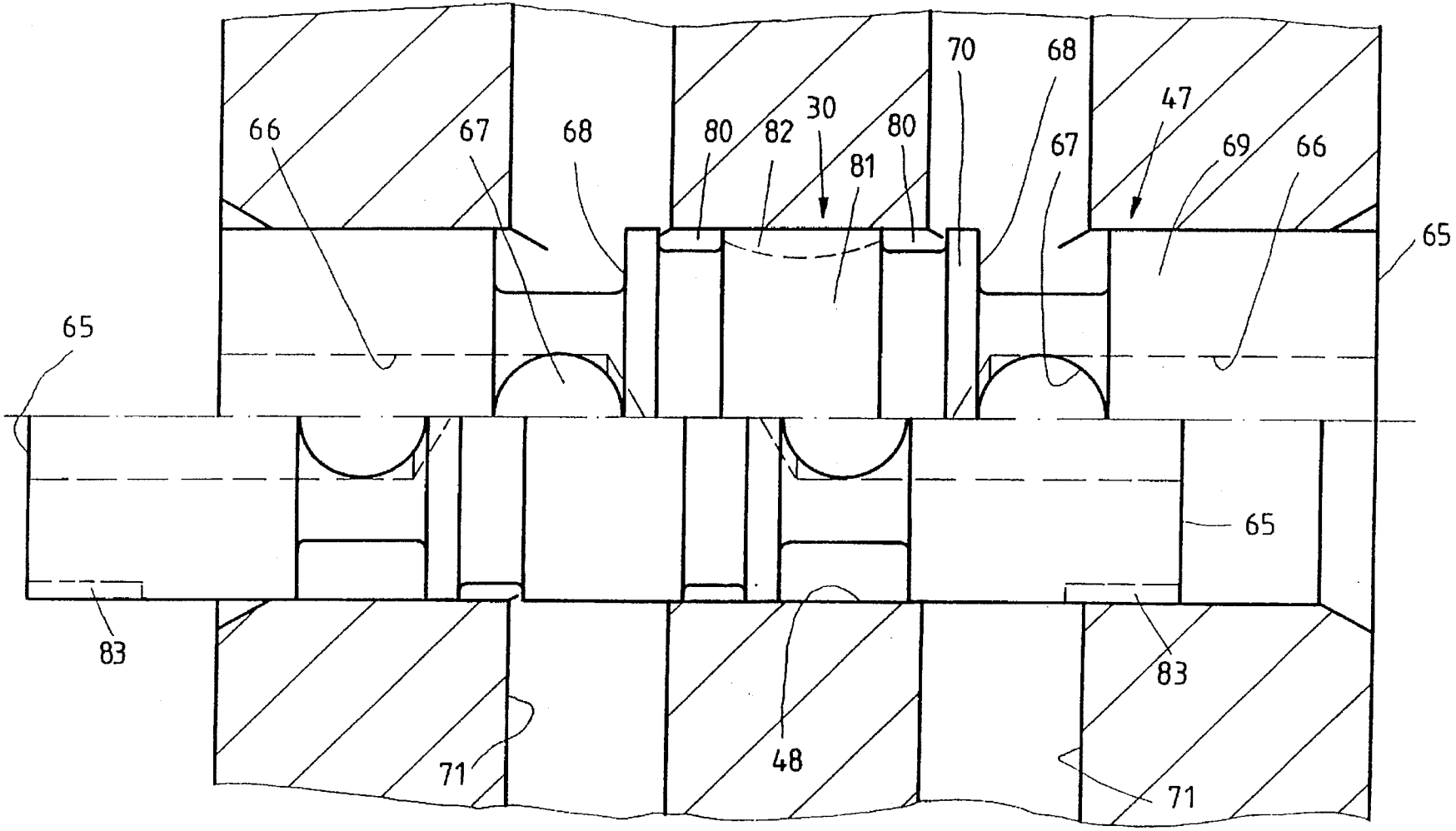
FIG. 7 is the overlay showing of the control piston of the directional valve from FIGS. 5 and 6.

It can be noted particularly clearly from FIG. 7 that the middle annular collar of the control piston 47 has, spaced from the two annular grooves 68, in each case a further annular groove 80 the depth of which, however, is far less than the depth of an annular groove 68. The bar 81 remaining between the two annular grooves 80 has a narrow lengthwise recess 82, via which, in the middle position of the control piston 47, the two channels 71 and 73, and thus the inlets and the outlets of the housing block 44, are connected to each other. The lengthwise recess 82 thus represents the flushing nozzle 30. Said connection is interrupted in a lateral working position of the control piston 47.

In the lower half of FIG. 7, the groove 83, which is open axially towards the end 65, is indicated by a dashed line in each end annular collar 69. A throttle 20 can then possibly be replaced by such a groove. As can be noted, one of the channels 71 is connected in a lateral working position of the piston 47 to the corresponding control chamber which, in its turn, is connected to the pre-control device 15.

We claim:

1. A hydraulic control device suitable for control of direction of movement and speed of a hydraulic consumer of a automobile working device, said hydraulic device comprising:

a directional valve having a control slide and a first control chamber and a second control chamber, said directional valve serving to modify the direction of movement and the speed of the hydraulic consumer;

a hydraulic pre-control device, by means of which a control pressure can be applied, via a first control line, to the first control chamber and, via a second control line, to the second control chamber of the directional valve; and a valve arrangement in said first control line by means of which a largely free flow of control oil is admitted to the first control chamber and by means of which, by a throttling of a discharge of the control oil, the movement of the control slide of the directional valve is damped;

wherein for damping of movement of the control slide, the cross-sectional area of flow of the valve arrangement in the first control line is effective for the discharge of control oil from the first control chamber and is variable as a function of the control pressure produced in the second line and in the second control chamber.

2. A hydraulic control device according to claim 1, wherein the damping of the movement of the control slide is disconnected below a given control pressure and connected above said control pressure.

3. A hydraulic control device according to claim 1, wherein the movement of the control slide can be damped as from a control pressure which is equal to about one third of the highest control pressure.

4. A hydraulic control device according to claim 1, further comprising a second directional valve, wherein the damping can be varied as a function of the position of the second directional valve.

5. A hydraulic control device according to claim 4, wherein, by means of the second directional valve, a bypass which bypasses a fixed throttle is connectable, and that the bypass is open in the position of rest of the second directional valve and is blocked to a greater or lesser extent in a working position of the second directional valve.

6. A hydraulic control device according to claim 5, wherein the second directional valve is a switch valve, and that the bypass is entirely blocked in a working position of the second directional valve.

7. A hydraulic control device according to claim 4, in the position of rest of the second directional valve, the pre-control device and first control chamber are connected unthrottled with each other via the second directional valve, and that in a working position of the second directional valve, a throttle place is connected into the first control line.

8. A hydraulic control device according claim 4, further comprising a non return valve connected in parallel to the second directional valve, wherein the non-return valve opens toward the first control chamber and is switched, and wherein the second directional valve is switchable as a function of the control pressure into a blocking position for the first control line.

9. A hydraulic control device according to claim 4, wherein a valve body of the second directional valve seeks to assume a position of rest under the action of at least one valve spring and is hydraulically actuatable against the force of the valve spring, and wherein, for the hydraulic displacement of the valve body, the first control chamber can be acted on by the control pressure prevailing in a control line and a second, spring-side control chamber can be acted on by the tank pressure prevailing in the other control line.

10. A hydraulic control device according to claim 9, wherein the valve body can be moved only in one direction from the position of rest, and that, regardless of in which control line a control pressure is present, the first control chamber can be acted on with control pressure and the second spring-side control chamber is actuatable with tank pressure.

11. A hydraulic control device according to claim 10, wherein the first control chamber can be connected via a change valve in each case with the control line which has the control pressure and the second spring-side control chamber can be connected via an inverted change valve in each case with the control line having the tank pressure.

12. A hydraulic control device according to claim 9, wherein the valve body seeks to assume a middle position of rest under the action of at least one valve spring, and that the first control chamber is connected to the one control line and the second control chamber is connected to the other control line.

13. A hydraulic control device according to claim 9, wherein each valve spring is pretensioned in the position of rest of the valve body, and that the valve body is movable out of the position of rest against the force of the valve spring without support by a further valve spring.

14. A hydraulic control device according to claim 4, wherein both control lines are provided with a valve arrangement for throttling the discharge of control oil, and wherein the throttling can be controlled in both control lines preferably by the single second directional valve having four working connections.

15. A hydraulic control device according to claim 9, wherein the second directional valve has a valve body formed as a control piston which is displaceable in a housing hole, on at least one end of which piston there is a control chamber connected to a working connection;

the control piston has a blind hole which is open on the end and extends in its longitudinal direction;

spaced from the end, a transverse hole debouches into the blind hole; and depending on the position of the control piston, the transverse hole is open or closed to a channel which debouches in the housing hole and is connected with the second working connection.

16. A hydraulic control device according to claim 4, further comprising a flushing nozzle which is connected between the two control lines and is integrated into the second directional valve.

17. A hydraulic control device according to claim 16, wherein the connection of the two control lines via the flushing nozzle is closed in an actuated position of the second directional valve.

18. A hydraulic control device according to claim 16, wherein the valve body is formed as control piston, and the flushing nozzle is formed by a longitudinal recess in an annular collar of the control piston of the second directional valve.

19. A hydraulic control device according to claim 4, wherein the valve arrangement and the second directional valve have a common housing.

20. A hydraulic control device according to claim 19, wherein the valve body is formed as a control piston, and the housing has first and second continuous parallel holes into each of which a throttle or throttle non-return valve is inserted; that the housing has a housing hole which extends parallel to a plane spanning the axes of the first and the second holes and perpendicular to the first and the second holes and in which there is the control piston of the second directional valve.

* * * * *